United States Patent [19]

Asbjornson et al.

[11] Patent Number: 4,808,068

[45] Date of Patent: Feb. 28, 1989

[54] BLOWER UNLOADING DEVICE

[75] Inventors: Norman H. Asbjornson, Edina; James V. Foty, Plymouth, both of Minn.

[73] Assignee: Intertherm Investments, Inc., Providence, R.I.

[21] Appl. No.: 924,215

[22] Filed: Oct. 28, 1986

[51] Int. Cl.[4] ..... F01B 25/02

[52] U.S. Cl. ..... 415/157; 415/158; 415/26

[58] Field of Search ..... 415/157, 158, 26

[56] References Cited

U.S. PATENT DOCUMENTS

| | | | |
|---|---|---|---|
| 2,143,100 | 1/1939 | Anderson | 415/157 |
| 2,290,770 | 7/1942 | Schumann | 415/157 |
| 2,430,225 | 11/1947 | Hagler | 415/157 |
| 2,431,398 | 11/1947 | Hasbrouck | 415/157 |
| 2,459,815 | 1/1949 | Hammell | 415/157 |
| 2,542,121 | 2/1951 | Earl | 415/157 |

*Primary Examiner*—Robert E. Garrett

*Assistant Examiner*—Therese M. Newholm

*Attorney, Agent, or Firm*—Anthony G. Eggink

[57] ABSTRACT

The blower unloading or air volume control device is for use with an air blower assembly having a fan wheel or impeller assembly mounted for rotation about the rear orifice in the air inlet funnel. The device comprises a moveable air deflecting member or cone aligned axially with the blower assembly inlet funnel for varying the entrance dimension to the impeller blades and for sealing the rear inlet funnel orifice. A mounting structure is fixed to the blower assembly for supporting the air deflecting cone. A linear movement mechanism operative on the air deflecting cone is provided to vary the stroke of the air deflecting cone based on pressure differential demands in the system serviced by the blower assembly. The air deflecting cone is movable from a position in the impeller assembly cavity to engage the rear orifice of the inlet funnel to control the air volume throughput and to, thereby, control the operating efficiency of the air blower assembly.

20 Claims, 4 Drawing Sheets

BLOWER UNLOADING DEVICE

BACKGROUND OF THE INVENTION

This invention relates to air blower assemblies, and more particularly, to a device for reducing the power requirements of blower assemblies through air flow reduction. The device of the invention is useful for increasing the operating efficiency of air blower assemblies used in commercial heating and cooling systems by controlling the air volume output.

The blower unloading or air volume control of this invention is particularly useful in controlling the power or energy requirements to drive the impeller or fan wheel of air blower assemblies. The control device of the invention provides effective and aerodynamic control of the air volume intake through the air blower assembly over a full range of operation to thereby control and unload the input power requirements of the blower impeller or fan wheel motor.

The aerodynamic air volume control device of the invention is further useful in effectively and efficiently directing the airflow into a blower assembly to reduce the air turbulence and resultant noise propagation usually associated with such assemblies and, particularly, with those utilizing air volume control devices.

The control device of this invention further provides air volume control directly at the air intake funnel from within the blower assembly cavity to thereby provide an effective and efficient means to regulate the air volume throughput over a full range of intake requirements including the total shut off of air intake to the fan wheel. And, the blower unloading device of the invention provides an air volume intake control device easily adaptable for use with common air blower assemblies.

In the past, various devices have been proposed and utilized to control air volume intake and blower assembly horse power requirements in commerical building environmental control systems. One such device utilizes a plurality of rotatable or pivotable vanes disposed across the entrance section of the blower inlet and which open for full airflow and alternatively close to limit air flow dependent upon the air volume requirement of the building's environmental system. Another control device utilizes a drum assembly that is movable about the outer periphery of the blower impeller assembly to, thereby, control the blower air volume output. Yet, other control devices are operative through the inlet and outlet portions of the blower assembly but which alter and disturb the desired smooth airflow therethrough.

These prior art devices have inherent limitations and difficulties associated with their respective structures and operations. For example, these air volume control devices are generally ineffective at low volume requirements and their respective minimum flow limits have been found difficult to reduce below 20 percent of full volume output. Another problem, particularly with the drum assembly control devices is their low energy efficiencies at common operating conditions. And, although the inlet vane type control systems are generally more energy efficient, they require complex and costly structural designs which aerodynamically interfere with the desired smooth airflow through the inlet funnel.

Another major problem associated with prior art control devices is the generation of noise which requires the costly addition of structural elements to the blower assembly itself or to the building structure if noise is to be suppressed. System noise is produced by the incoming airflow directed against the inlet vanes, for example, as well as the interior blower assembly surfaces, which cause air turbulence in the blower assembly and harmonic vibrations of the blower structural elements. The prior art control devices, therefore, generally have design configurations which create further air turbulence and exacerbate noise propagation.

Despite the need for an effective and efficient air volume control device usable with standard blower assemblies for commercial air heating and cooling systems, and which overcomes these prior art difficulties and limitations, none insofar as is known has been proposed or developed.

Accordingly, it is an object of the present invention to provide a blower unloading device which effectively and efficiently controls the air output volume of a blower assembly over its total operating range, while at the same time substantially reducing the blower's energy consumption. It is a further object of this inveniton to provide a device which is particularly effective at controlling low vlume air flow. It is another object of this invention to provide a device capable of effectively sealing the inlet funnel of the blower to completely shut off air intake.

A further object of this invention is to provide a device which is constructed and arranged to control noise propagation over a broad range of operating conditions. It is also an object of this invention to provide a control device having a structural configuration which reduces air turbulence in the blower assembly throughout its total range of operation.

It is also an object of the present invention to provide a device which fulfills the above-mentioned objects within standard blower design parameters commonly used in the industry.

SUMMARY OF THE INVENTION

The blower unloading or air volume control device is for use with an air blower assembly having an impeller or fan wheel structure mounted on a drive shaft for rotation about the exit section of an inlet funnel. The device controls the air volume intake through the inlet funnel from within the blower assembly cavity.

The device comprises a non-rotating air deflecting member or cone aligned axially with the blower assembly inlet funnel for varying the entrance dimension of the rotating impeller assembly blades and for totally sealing the inlet funnel. A mounting structure fixed within the blower assembly is provided supporting the movable deflecting cone. The device further comprises means to linearly move the deflecting cone to and away from the rear orifice of the inlet funnel. Means to detect a pressure differential at a location serviced by the air blower assembly is provided to activate the linear movement of the deflecting cone. The cone is moveable from a position near the back plate of the impeller assembly to a sealing position with the inlet funnel to fully control the air volume throughput based upon air volume demand of the system as measured by a pressure differential.

The air deflecting cone preferably has a sloped surface and a structural peripheral rim to sealingly engage the rear orifice of the inlet funnel. The mounting structure is a rigid, elongated, tubular sleeve connected at one end to the impeller drive shaft by a ball bearing assembly and fixed to the blower housing at its other end on a frame structure. The mounting structure is hollow, disposed around the fan wheel drive shaft of the blower assembly, and extends through the center of the inlet funnel. The linear movement is achieved through the use of a lead screw and gear motor or a linear actuator connected to the air deflecting cone and which are constructed and arranged to move the cone on the mounting structure in axial alignment with the inlet funnel.

The device of this invention provides for the efficient and effective control of airflow to the blower assembly based on system air volume demand. And, the device provides control for use with standard air blower designs to reduce energy requirements and with reduced noise propagation.

These and other benefits of this invention will become clear from the following description, by reference to the drawings.

DESCRIPTION OF THE PREFERRED EMBODIMENTS

Figure 1:
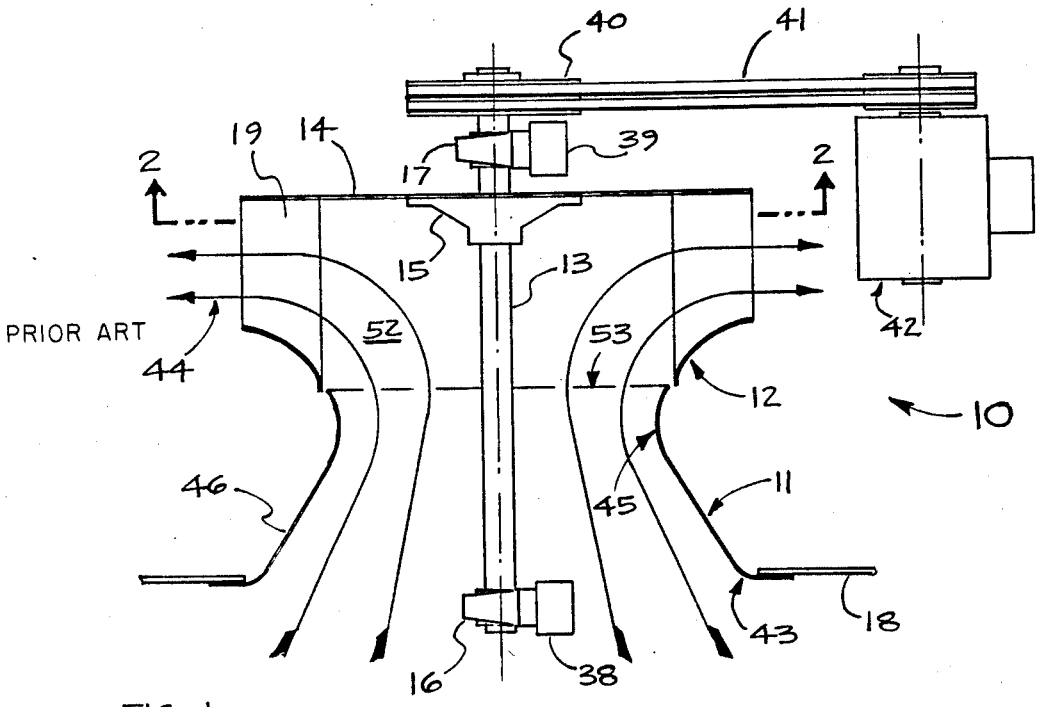
FIG. 1 is a cross-sectional side view of a standard air blower assembly which shows its structural elements and the movement of airflow therethrough.

FIG. 1 shows a standard centrifugal blower fan assembly 10 used to supply airflow into a heating and cooling system for a building. The blower assembly 10 is shown to have an inlet funnel 11, an impeller or fan wheel assembly 12, a drive shaft 13, and a motor 42. The inlet funnel 11 is placed at a location on a blower housing structure 18 of an environmental control system where air is desired to be taken in. The inlet funnel 11 has a rounded or curved wall structure 46 wherein its entrance section or inlet orifice 43 and exit section or rear orifice 53 dimensions are larger than its median section 45. This inlet funnel configuration generally matches that of airstream flow through a rounded orifice whereby downstream the plane of the orifice its narrowest cross-section or vena contracta is formed. This inlet funnel 11 construction brings in a large volume of air by maximizing laminar airflow and minimizing turbulence.

Figure 2:
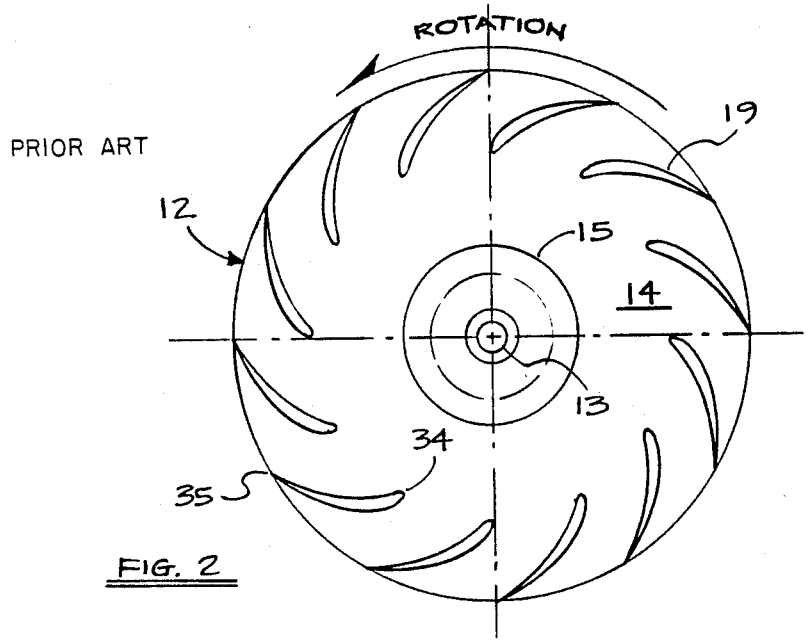
FIG. 2 is a cross-sectional view of the impeller of the air blower assembly taken along lines 2—2 of FIG. 1.

The impeller or fan wheel assembly 12 is disposed immediately behind the rear or exit orifice 53. As is shown in FIG. 2, the impeller assembly 12 is a circular wheel having a plurality of curved or air foil shaped blades 19, a back plate 14 and a central cavity 52. Each blade 19 has a relatively thick leading edge 34 and a relatively thin trailing edge 35. The blades 19 are generally circumferentially disposed about the assembly 12 with the leading edge 34 extending slightly inwardly towards the center or axis of the impeller assembly 12 so that each blade 19 is angled relative to the radius of the impeller 12 in a manner suitable for application requirements. The blades 19 are fixed to and extend from the circular back plate 14. The impeller 12 is shown to rotate in a counter-clockwise direction as viewed through the inlet funnel 11. The blades 19 are slightly curved away from the direction of rotation of the impeller 12.

Size parameters for the impeller 12 may vary and are dependent upon the air volume and static pressure requirements of the environmental control system for which the blower assembly 10 is designed. Fan design parameters including the overall diameter of the impeller 12, the width and thickness of the individual blades 19 as well as the number and geometric shape of the blades 19 are considered. The unloading device of this invention is usable with any of these impeller designs and sizes.

The impeller 12 is shown in FIG. 1 being connected to the rigid and rotatable drive shaft 13 by a hub 15. The drive shaft 13 is axially disposed through the inlet funnel 11 and is supported at its ends by an inlet bearing assembly 16 and a base bearing assembly 17. The bearing assemblies 16 and 17 are connected to the front frame structure 38 mounted to the assembly housing 18 and to the fixed back frame structure 39.

The drive shaft 13 has a pulley 40 disposed at its end extending from the base bearing assembly 17 behind the back plate 14. The pulley 40 is operationally connected to a motor 42 or other drive means via a belt or belts 41. The motor(s) 42 may be directly or otherwise connected to the drive shaft 13 as is known in the art. The torque by motor 42 on the drive shaft 13 results in the constant rotation of the impeller 12.

Airflow into inlet funnel 11 by the action of rotating impeller 12 enters the central cavity or chamber 52 and is then directed radially from the impeller 12 as exhausted airflow 44. The horsepower requirement or amperage of the blower assembly motor 42 is generally proportional to the degree of exposure of the rotating impeller blades 19. Therefore, horsepower unloading is accomplished by restricting the access or exposure of the impeller blades of the fan wheel 12 to airflow through the inlet funnel 11.

Figure 3:
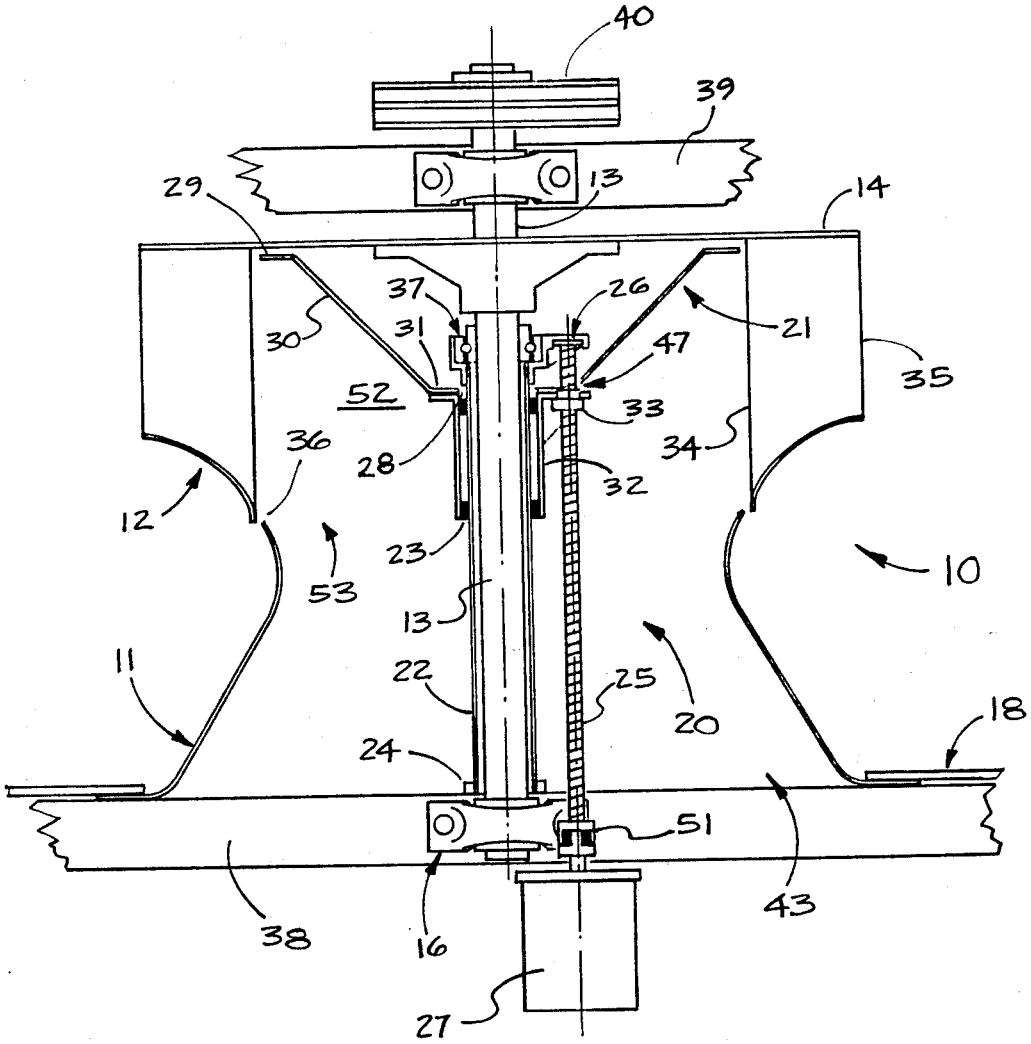
FIG. 3 is a cross-sectional top view of an air blower assembly having the air volume control device of the present invention.

FIG. 3 shows the blower unloading or air volume control device 20 of the invention mounted for operation in an air blower assembly 10. The device 20 has an air deflecting member or cone 21 for airflow control, a guide sleeve 22 for support of the cone 21, a lead screw 25 for movement of the cone 21, and a motor 27 which rotates or turns the lead screw 25. The device 20 is for controlling the volume of air taken into the blower 10 and thus for controlling its power requirements.

The air deflecting cone 21 is a non-rotating, frustoconical disc. The cone 21 is non-rotating because a stationary design improves balance, provides improved actuation and is less complex structurally. The cone 21 has a structural seating and air deflection rim 29 disposed at its periphery for directing airflow toward the impeller assembly 12. The rim 29 sealingly engages the rear orifice 53 of the inlet funnel 11. A body surface 30 provides aerodynamic deflection for air flow control, and a center portion 31 attaches the cone 21 to a movable guide structure 32. The center portion 31 has a central aperture 28 and a lead screw aperture 47.

The body surface 30 slopes rearwardly from the center portion 31 which covers the hub assembly and to deflect the incoming airstream. The structural seating and air deflection rim 29 extends outwardly from body surface 30 generally parallel the back plate 14.

The cone 21 is constructed and arranged to provide efficient airflow control through blower assembly 10 as well as for sealing the air inlet funnel 11. The cone 21 is rigid and composed of metal or a similar substance or composite. Its size and shape vary dependent upon the shape and dimensions of the rear orifice 53 of the inlet funnel 11 and of the hub 15.

The position of the cone 21 is variable within the central cavity 52 of the impeller assembly 12 from generally the back plate 14 to the point where it closes or seals the inlet funnel 11 at its rear or exit orifice 53. The stroke or range of movement of the cone 21 defines the entrance dimension 50 to the impeller blades 19 which determines the amount or width of exposure to airflow of the blades 19. When the device 20 is at its fully open position, airflow through the inlet funnel 11 is unimpeded and the entire width of each impeller blade 19 is active in providing airflow. At this position, the seating and air deflection rim 29 is in close proximity with the back plate 14 which improves the airflow through the blower 10 and reduces turbulence. Airflow through the blower assembly 10 causes a corresponding increase in air volume to the system. Additionally, horsepower consumption or blower load is at its maximum. When the device 20 is in a fully closed position, the cone 21 seals the rear orifice 53 of the inlet funnel 11 wherein the air deflection rim 29 engages the rear circumferential edge 36 of the rear orifice 53. At this position, airflow through the inlet 11 is reduced to zero which decreases system air pressure and unloads the impeller 12 to thereby reduce the power requirement of motor 42.

Figure 4:
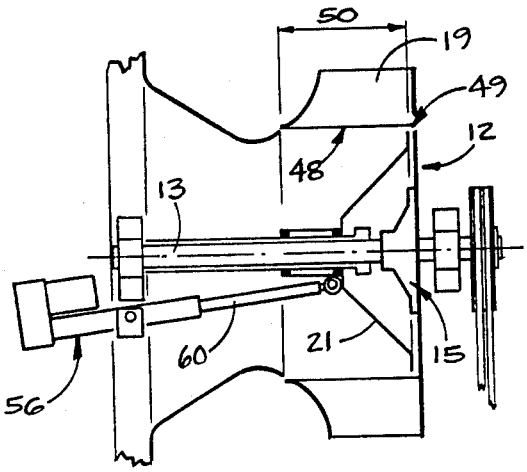
FIG. 4 shows the air volume control device in a substantially open position allowing approximately 90% of full airflow through the blower assembly.
Figure 5:
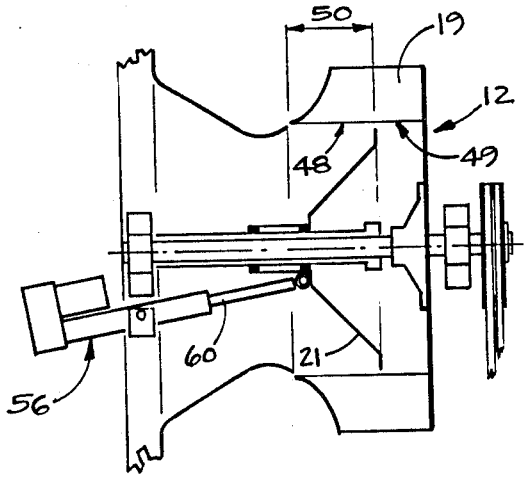
FIG. 5 shows the air volume control device at an intermediate setting allowing approximately 50% of full airflow through the blower assembly.
Figure 6:
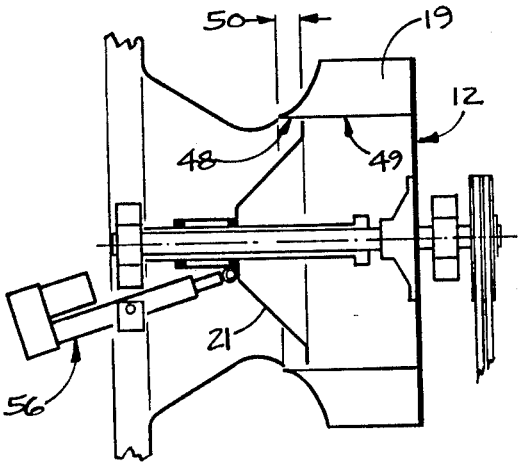
FIG. 6 shows the air volume control device in a substantially closed position allowing approximately 10% of full airflow through the blower assembly.

FIGS. 4, 5 and 6 show the air volume control device 20 at intermediate positions between fully open and closed for maintaining pressure equilibrium in the system. The device 20 deactivates the impeller blades 19 from the back plate 14 forwards. This type of deactivation does not disturb the smooth flow of air along the inlet and impeller assembly surfaces.

Referring to FIG. 4, the device 20 is in a substantially open operational position where a large front portion 48 of each blade 19 is exposed for moving air. Only a small rear portion 49 of each blade 19 is deactivated (approximately 10%) by the air deflection cone 21 in this position. FIG. 5 shows the device 20 at an intermediate position or setting (approximately 50%) where the entrance dimension 50 of the impeller blades 19 is smaller than shown in FIG. 4. The deflection cone 21 position effectively limits the active front portion 48 of the impeller blades. This position results in less air volume being moved by the impeller 12 and, thus, less horsepower consumption. FIG. 6 shows the device 20 in a substantially closed position allowing approximately 10% of full volume operation of the blower assembly 10. In this position, the device 20 limits the exposure of the impeller 12 to the front portion 48, as shown, which deactivates a large rear portion 49 of the impeller blades 19.

Figure 7:
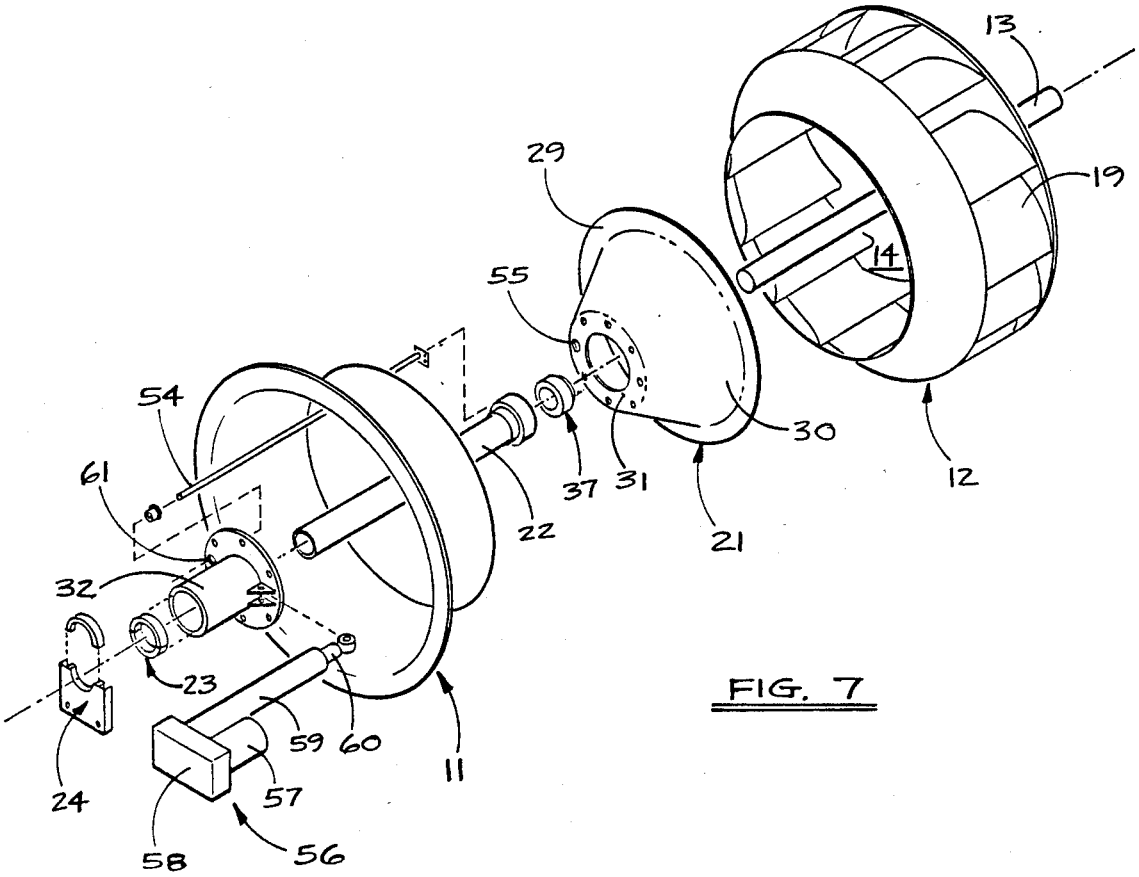
FIG. 7 is a perspective view of the structural elements of the blower unloading device of this invention and which are shown in a separated stated for clarity.

Referring to FIGS. 3 and 7, the cone 21 is moveably mounted on a fixed, rigid and hollow tubular guide sleeve 22 which is disposed around the drive shaft 13 and which extends through the central aperture 28 in the center portion 31 of the cone 21. The sleeve 22 extends from a point near the impeller hub 15 through the central cavity 52 and inlet funnel 11 to the inlet frame 38. The sleeve 22 is coupled at one end to the drive shaft 13 by a stationary bearing assembly 37. The bearing assembly 37 allows the drive shaft 13 to turn without imparting motion to the sleeve 22. The other end of the sleeve 22 is likewise mounted to the inlet frame 38 by a connector portion 24. The sleeve 22 provides a stationary support for the movable cone 21 throughout its range of movement. The cone is slidably mounted to the sleeve 22 along its length by means of a guide structure 32 which has guide bearings 23 and provides a stable linkage for the conesleeve configuration. The guide structure 32 is attached to the center portion 31 of the cone 21.

Referring to FIG. 3, an internally threaded lead screw linkage member 33 is disposed in the guide structure 32 for communicative connection with the lead screw 25. The lead screw or jack shaft 25 is rigid, elongated and threaded metal rod which is rotatably connected by a thrust bearing 26 at one end to the bearing assembly 37. The lead screw 25 is disposed adjacent and parallel to the sleeve 22 and extends from the thrust bearing 26 through the lead screw aperture 47 in the deflection cone 21 and the lead screw linkage member 33 in the guide structure 32. The lead screw 25 is composed of a durable metal or the like able to withstand high torque due to the air pressure on the deflection cone 21. Preferably, a single lead screw 25 is used for cone 21 stroke adjustment, however, more than one lead screw 25 may be used if desired or necessary.

Rotation of the lead screw 25 is accomplished by a reversible motor 27 which axially moves the deflection cone 21 in the central cavity 52. The motor 27 is shown mounted to the inlet frame 38 by a bracket or connector 51. The motor 27 is controlled by conventional switching means, such as a contact control mechanism which is connected to sensing means, such as photohelic static pressure probes located at predetermined locations in the environmental control system serviced by the blower assembly 10. The sensing means detects pressure differentials in the system to activate the motor 27 and to, thereby, adjust the position of the deflection cone 21 relative to the rotating impeller assembly 12.

FIG. 7 shows an alternative embodiment of the device 20 of the present invention. The device 20 is shown utilizing a linear actuator 56 to move the cone 21 instead of the rotatable lead screw 25 and motor 27 assembly shown in FIG. 3. The linear actuator 56 is a slow speed, a.c. actuator, for example the Elektrak (TM), manufactured by Warner Electric Brake and Clutch Co. The linear actuator 56 provides desirable switching characteristics and accurate position sensing through positional feedback with its electronic control mechanism. Thus, the stroke of the actuator, and therefore, the positioning of the attached deflection member can be easily adjusted by limit switches or the like.

The linear actuator 56 has an a.c. electric motor 57, a gear train 58, a drive screw 59, and an extension tube 60. The linear actuator 56 is pivotally linked to the front frame structure 38 and to the guide structure 32.

In the embodiment of the invention utilizing the linear actuator 56, rotation of the cone 21 is prevented by a rigid, elongated stabilizing member 54 which is disposed parallel and adjacent to the support sleeve 22 generally along its length. The stabilizer 54 extends through an aperture 61 in the guide structure 32 and an aperture 55 in the cone 21.

It is also within the purview of this invention to utilize a plurality of blower assemblies in a building's environmental system. In this case a plurality of deflection member drive means would be utilized. For example, an a.c. linear actuator or lead screw would be operative on the deflection member in each blower assembly. In this case, if the assemblies are arranged in parallel or in-line a main feedback unit can be utilized to simultaneously adjust the respective strokes of the drive means.

As many changes are possible to the embodiments of this invention utilizing the teachings thereof, the descriptions above, and the accompanying drawings should be interpreted in the illustrative and not the limited sense.

That which is claimed is:

1. An automatically activated, non-rotating aerodynamic blower unloading device used in an environmental control system and for internally controlling a large air volume centrifugal fan assembly concentrically mounted for rotation to an air inlet funnel having a rounded air inlet funnel having a rounded intake orifice and a rear orifice periphery with a predetermined diameter, the fan assembly having a back plate, a plurality of fan blades having a predetermined width, a central cavity and a drive shaft with a hub assembly mounted to the back plate and extending axially therefrom through the central cavity and the intake and rear orifices, said blower unloading device comprising:

a. a fixed cylindrical support structure with respect to the rotating fan assembly mounted concentrically about the drive shaft of the fan assembly and extending from the drive shaft hub through the central cavity at least to the rear orifice of the air inlet funnel, b. an internally active air deflection member movably mounted to said fixed support structure for controlling the airflow through the air inlet funnel, said air deflection member having an aerodynamic and generally frusto-conical frontal structure and being concentrically movable on said support structure from the fan assembly back plate to the inlet orifice and further having a predetermined diameter to abut and seal the rear periphery of the air inlet funnel, c. drive means operative on said air deflection structure and being connected to the front thereof for moving said air deflection frontal structure a predetermined distance in the central cavity of the fan assembly for reducing airflow and, thus, the power requirements of the centrifugal fan, and d. means to activate said drive means, said means being remotely located and being automatically operated based upon pressure differentials in the environmental control system.

2. The blower unloading device of cliam 1, wherein said air deflection member further has a structural peripheral rim portion disposed generally parallel the fan assembly back plate and being disposed proximate the back plate when said air deflection member is in its rearward position.

3. The blower unloading device of claim 2, wherein said predetermined distance of movement of said air deflection member is from said rearward position to the rear orifice of the air inlet funnel whereby said air deflection member is movable in the central cavity to unload the air volume intake to the centrifugal fan assembly and to fully unload the fan assembly when said air deflection member sealingly engages the rear orifice of the inlet funnel.

4. The blower unloading device of claim 1, wherein said cylindrical support structure has a non-rotating bearing assembly fixed at one end thereof, said bearing assembly being mounted about the fan assembly drive shaft forward the hub assembly in the central cavity, the intake orifice of the inlet funnel further having an inlet frame structure disposed thereacross for supporting the drive shaft, said cylindrical support structure being fixed at the opposite end to the inlet frame structure.

5. The blower unloading device of claim 4, wherein said air deflection member has a central aperture for the concentric movement about said cylindrical support structure and wherein a guide structure generally concentric with said central aperture and having an interior guide bearing assembly is attached to said air deflection member to slidably engage said cylindrical support structure.

6. The blower unloading device of claim 5, wherein said bearing assembly further has a stop member attached thereto, wherein said guide structure has an interiorly threaded linkage structure attached thereto in alignment with said stop member, and wherein said drive means includes an exteriorly threaded lead screw engaging said linkage structure and further coupling said stop member at one end, said drive means further including a two-directional motor attached to the opposite end of said lead screw and being mounted to the inlet frame structure, said motor further being activatable by means sensing air volume requirements to the system serviced by the fan assembly based upon pressure differential therein, whereby the rotation of said lead screw translates said air deflection member along said cylindrical support structure.

7. The blower unloading device of claim 5, wherein said drive means is a linear actuator fixed in a stationary position outside the intake orifice and connected to said guide structure, said linear actuator having a motor, a gear train and a drive screw and being extendible and retractable to concentrically move said air deflection member.

8. An automatically activated, non-rotating blower unloading device for internally controlling the air volume intaken to a large air volume blower assembly having an air inlet funnel with a rear orifice of a predetermined diameter and a centrifugal fan assembly mounted on a axially aligned drive shaft for rotation about the inlet funnel rear orifice and having a back plate, a plurality of fan blades and a central cavity, said non-rotating blower unloading device comprising:

a. an axially aligned, stationary mounting sleeve structure having a continuous, smooth outer surface and being disposed about the fan assembly shaft and extending from the back plate through the blower cavity to the rear orifice of the inlet funnel, b. an internally active non-rotating air deflection member with respect to the fan assembly having a predetermined diameter with being axially aligned with the blower assembly orifice, said air deflection member being constructed and arranged to be concentrically moveable on said mounting structure to control and aerodynamically direct airflow through the rear orifice of the inlet funnel, and c. means to automatically move said air deflection member on said mounting structure through a predetermined distance in the blower cavity for engagingly sealing the rear orifice of the inlet funnel, said moving means being controlled by the air volume requirement of the air blower assembly and being automatically activated by air pressure differentials at a remote location, whereby the movement of said air deflection member in the blower cavity controls the air volume to the centrifugal fan assembly to control the power requirements thereof.

9. The blower unloading device of claim 8, wherein said air deflection member has a frusto-conical configuration with a conic surface, a peripheral rim structure for the sealing engagement of the inlet funnel rear orifice and a frontally disposed truncated surface.

10. The blower unloading device of claim 8, wherein said mounting structure is a rigid, hollow and stationary tubular sleeve concentrically disposed about the rotatable fan assembly drive shaft and coupled at one end thereto by a bearing mount, said sleeve being fixed at its other end at a location outside the blower assembly.

11. The blower unloading device of claim 8, wherein said air deflection member has at least one aperture and wherein said moving means has at least one lead screw extending through said aperture and being disposed adjacent and parallel to said mounting structure, said lead screw further being communicatively linked to said air deflection member, and a motor connected to said lead screw at one end, whereby the rotation of said lead screw by said motor slidably moves said air deflection member along said mounting structure through the blower cavity.

12. The blower unloading device of claim 8, wherein said moving means is a linear acutator fixed in a stationary position outside the inlet funnel and connected to said air deflection member, said linear actuator being extendible and retractable to move said air deflection member.

13. The blower unloading device of claim 8, wherein said air deflection member moving means is activated by a pressure differential sensor located in the environmental system serviced by the blower assembly.

14. an air intake control device activatable in an environmental control system high volume air blower being a circular inlet funnel and a concentrically driven, constant-speed flail having a central cavity, an axial drive shaft and a plurality of peripherally disposed blades disposed for axial rotation at the exit section of the inlet funnel comprising:

a. a non-rotating air deflection cone aligned axially with the blower inlet funnel, said air deflection cone being constructed and arranged to control airflow through the inlet funnel, b. means to moveably and concentrically support said air deflection cone through a range of positions extending from the central cavity of the flail to the exit section of the inlet funnel, c. means to linearly move said non-rotating air deflecting cone through said range of positions, and d. means to activate said linear moving means, said means being sensitive to pressure differentials in the environmental control system, whereby, said non-rotating air deflection cone is moveable from a rear position in the central cavity of the flail to a position engaging the exit section of the inlet funnel to aerodynamically control the air intake volume therethrough and to , thereby, control the power load requirement of the flail as activated by pressure differentials from the environmental control system.

15. The air volume intake control device of claim 14, wherein said air deflection cone is disposed toward the exit section of the air blower inlet funnel and further has a base diameter generally equivalent to the inlet funnel diameter, a conic surface rearwardly angled relative to the axis of said air deflection cone, and a peripheral rim portion which engages the inlet funnel exit section periphery for sealing the inlet funnel.

16. The air volume intake control device of claim 14, wherein said air deflection cone has a first and a second aperture disposed generally in its center and wherein said support means is a rigid, hollow, stationary sleeve disposed around the drive shaft, extended through said first aperture, movably coupled at one end to the drive shaft and attached to an elongated and narrow inlet frame at its other end, the inlet frame being disposed across the entrance section of the inlet funnel, said air deflection cone further being slidably coupled to said sleeve, and wherein said linear movement means includes a lead screw disposed adjacent and parallel to said sleeve and extending through said second aperture, and at least one motor connected to said lead screw, whereby said motor rotates said lead screw to slidably move said air deflection cone along said support means through said predetermined distance of air deflection cone moveability.

17. The air volume intake control device of claim 14, wherein said air deflection cone has an aperture disposed generally in its center and wherein said support means is a rigid, hollow, stationary sleeve disposed around the drive shaft, extended through said air deflection cone aperture, movably coupled at one end to the drive shaft and attached to an elongated and narrow inlet frame at its other end, the inlet frame being disposed across the entrance section of the inlet funnel, said air deflection cone further being slidably coupled to said sleeve, and wherein said linear movement means is a linear actuator, said linear actuator having a motor, a gear train and a drive screw, said linear actuator being fixed in a stationary position outside the entrance section of the inlet funnel and connected to said air deflection cone, said linear actuator being extendible and retractable to move said air deflection cone.

18. An internally active and non-rotating air volume control device for use with the air blower assembly of an environmental control system having a constant-speed impeller mounted on an axial drive shaft for rotation about the exit section of a circular, vena contracta inlet funnel, the impeller further having a plurality of circumferentially disposed blades and a generally hollow central cavity, said air volume control device being for adjusting the air entrance dimension of the impeller to thereby control air pressure in the environmental control system and the power requirement of the impeller, comprising:

a. a non-rotating frusto-conical deflection disc structure having a frontally protruding nose surface and being aligned axially with the inlet funnel and generally disposed within the central cavity of the impeller so that it projects toward the exit section of the inlet funnel, said conical surface of said air deflection disc structure having an outer diameter generally equivalent to the diameter of the inlet and at least one aperture in its center, and being constructed and arranged to be concentrically moveable toward the inlet funnel to control airflow through and to abuttingly seal the inlet funnel, b. a hollow, tubular mounting structure having a smooth surface being disposed around the drive shaft and aligned axially through the inlet and the impeller, and thereaffixed in a stationary position to a frame at the entrance section of the inlet funnel and having a bearing assembly coupled to the drive shaft in the impeller and to moveably support said air deflection disc through a predetermined range of positions extending from the impeller central cavity to the inlet funnel exit section, said mounting structure further extending through said aperture in said air deflection disc, c. linear movement means communicatively connected to the frontally protruding surface of said air deflection disc, said linear movement means adjustably positioning said air deflection disc throughout said range of positions, and d. switching means to activate said linear movement means based upon changes in the air pressure requirement of the environmental control system.

19. The air volume control device of claim 18, wherein said linear movement means has a rotatable lead screw disposed adjacent and parallel to said mounting structure, said lead screw extending through said aperture in said air deflection disc and being coupled thereto by a linkage member, said linear movement means further having at least one motor connected to said lead screw at one end.

20. The air volume control device of claim 18, wherein said linear movement means is a linear actuator having a motor, a gear train and a drive screw, said linear actuator being fixed in a stationary position outside the air entrance dimension of the impeller and connected to said air deflection disc, said linear actuator being extendible and retractable to move said air deflection disc.

* * * * *